US009975692B2

(12) United States Patent
Pincus et al.

(10) Patent No.: US 9,975,692 B2
(45) Date of Patent: May 22, 2018

(54) EARPHONE PACKAGING

(71) Applicant: Apple Inc., Cupertino, CA (US)

(72) Inventors: Derek Bowman Pincus, Sunnyvale, CA (US); Lorraine Y. Tang, San Francisco, CA (US)

(73) Assignee: Apple Inc., Cupertino, CA (US)

( * ) Notice: Subject to any disclaimer, the term of this patent is extended or adjusted under 35 U.S.C. 154(b) by 110 days.

(21) Appl. No.: 15/236,032

(22) Filed: Aug. 12, 2016

(65) Prior Publication Data

US 2018/0044102 A1 Feb. 15, 2018

(51) Int. Cl.

| | |
|---|---|
| ***B65D 85/671*** | (2006.01) |
| ***B65D 65/40*** | (2006.01) |
| ***B65D 73/00*** | (2006.01) |
| ***B65D 75/06*** | (2006.01) |
| ***B65H 75/06*** | (2006.01) |

(52) U.S. Cl.

CPC ..... *B65D 85/671* (2013.01); *B65D 65/40* (2013.01); *B65D 73/0078* (2013.01); *B65H 75/06* (2013.01); *B65H 2701/3919* (2013.01)

(58) Field of Classification Search

CPC .. B65D 85/671; B65D 65/40; B65D 73/0078; B65H 75/06; B65H 2701/3919

USPC ..... 206/408, 531, 702, 320, 37; 381/384

See application file for complete search history.

(56) References Cited

U.S. PATENT DOCUMENTS

| | | | | |
|---|---|---|---|---|
| 5,887,720 | A * | 3/1999 | Lin | H04R 1/10 206/38 |
| 6,966,791 | B1 * | 11/2005 | Farr | B65H 75/406 206/303 |
| D600,673 | S * | 9/2009 | Kim | D14/205 |
| D620,781 | S * | 8/2010 | Weckworth | D8/356 |
| D685,771 | S * | 7/2013 | Bertenthal | D14/223 |
| 8,787,610 | B2 * | 7/2014 | Stevinson | H04R 1/1033 381/384 |
| D712,748 | S | 9/2014 | Akana et al. | |
| D713,674 | S * | 9/2014 | Rae | D7/394 |
| D713,738 | S | 9/2014 | Akana et al. | |
| D713,739 | S | 9/2014 | Akana et al. | |
| 8,842,872 | B2 * | 9/2014 | Stevinson | H04R 1/1033 381/384 |
| 2003/0106823 | A1 * | 6/2003 | Liao | B65H 75/4434 206/408 |
| 2007/0154048 | A1 * | 7/2007 | Chang | H04M 1/05 381/371 |

(Continued)

OTHER PUBLICATIONS

U.S. Appl. No. 29/432,147, filed Sep. 13, 2012, inventors Akana et al.

*Primary Examiner* — Chun Cheung
(74) *Attorney, Agent, or Firm* — Sterne, Kessler, Goldstein & Fox P.L.L.C.

(57) ABSTRACT

A package for an electronic device is disclosed. The package includes a first layer of compressed natural fibers defining an aperture and a second layer of compressed natural fibers disposed adjacent to the first layer of compressed natural fibers. The aperture is configured to receive a portion of the electronic device. The second layer of compressed natural fibers has a flap partially covering the aperture defined by the first layer of compressed natural fibers. The first and second layers of compressed natural fibers are bonded to each other by high-frequency welding.

20 Claims, 11 Drawing Sheets

(56) References Cited

U.S. PATENT DOCUMENTS

| | | | | |
|---|---|---|---|---|
| 2011/0317865 | A1* | 12/2011 | Stevinson | H04R 1/1033<br>381/384 |
| 2012/0128193 | A1* | 5/2012 | Stevinson | H04R 1/1033<br>381/384 |
| 2013/0105342 | A1* | 5/2013 | Yamamoto | H04R 1/1033<br>206/320 |

* cited by examiner

EARPHONE PACKAGING

FIELD

The described embodiments relate generally to packaging and specifically to earphone packaging.

BACKGROUND

Earphone packaging may be used, for example, to store, transport, protect and/or present earphones to consumers.

SUMMARY

The present disclosure details systems, apparatuses, and methods related to a package for an electronic device, such as earphone packaging. A package for an electronic device may include a first layer of compressed natural fibers defining an aperture and a second layer of compressed natural fibers disposed adjacent to the first layer of compressed natural fibers. In some embodiments, the aperture receives a portion of the electronic device. In some embodiments, the second layer of compressed natural fibers has a flap partially covering the aperture of the first layer of compressed natural fibers. The first and second layers of compressed natural fibers may be bonded to each other by high-frequency welding. For example, the first and second layers of compressed natural fibers may include a coating or film, such as a polypropylene laminate. The polypropylene laminate of the first and second layers may be high-frequency welded together, thus bonding the first and second layers of compressed natural fibers to each other.

In some embodiments, the first layer is paper. In some embodiments, the second layer is paper. In some embodiments, the second layer includes two flaps partially covering the aperture defined by the first layer of compressed natural fibers. In some embodiments, the package also includes a third layer of compressed natural fibers disposed adjacent to the first layer on an opposite side from the second layer. In some embodiments, the first layer defines a second aperture. In some embodiments, the third layer includes a flap partially covering the second aperture defined by the first layer. In some embodiments, the third layer completely covers the aperture defined by the first layer. In some embodiments, the third layer is bonded to the second layer by high-frequency welding. In some embodiments, the first, second, and third layers constrain the electronic device in three dimensions.

In some embodiments, each layer of compressed natural fibers includes a coating of polypropylene laminate. The first layer may form an exterior of the package.

In some embodiments, a packaged product includes the packaging described above and a product. The product may include a product body and a cable connected to the product body. In some embodiments, a portion of the product body is above the first layer. In some embodiments, a portion of the product body is below the first layer. The cable may not be visible from above the first layer.

In some embodiments, a perimeter of the aperture of the first layer is smaller than a perimeter of the product body. The flap may be biased to press the product body against the perimeter of the aperture.

In some embodiments, a package includes a compressed natural fiber earphone support, a compressed natural fiber cable support, and a compressed natural fiber cable guide. The compressed natural fiber earphone support may include a first compressed natural fiber layer and a second compressed natural fiber layer. In some embodiments, the first and second compressed natural fiber layers define two holes configured to secure the earphones. In some embodiments, the compressed natural fiber cable support is attached to the compressed natural fiber earphone support. In some embodiments, the cable support and the second compressed natural fiber layer are monolithic. In some embodiments, the compressed natural fiber cable guide is attached to the cable support and includes projections. Each projection may have tabs on each end arranged at an angle to form an annular guide for a coiled cable of the earphones.

In some embodiments, the package includes a connector support attached to the cable support. The connector support may include an aperture to receive a connector of the earphones. In some embodiments, the package includes an accessory support attached to the connector support. The accessory support may include an additional aperture to receive an accessory.

In some embodiments, the cable guide includes a passageway that surrounds the cable of the earphones. The passageway may break away when a user opens the package, allowing the cable to be removed from the package.

In some embodiments, the package includes a side portion that is monolithic with the compressed natural fiber cable support and the second compressed natural fiber layer, and the side portion may form a side of the package. In some embodiments, the package includes two tabs that extend from the cable support, and each may form a side of the package. In some embodiments, the two tabs and the side portion are not visible from above the first compressed natural fiber layer when the package is closed.

In some embodiments, the second compressed natural fiber layer includes flaps partially covering the two holes to secure the earphones. In some embodiments, a grammage of the first compressed natural fiber layer is greater than a grammage of the second compressed natural fiber layer.

In some embodiments, packaged earphones include the package described above and the earphones. In some embodiments, the earphones are secured within the two holes. In some embodiments, the cable of the earphones extends from the earphones in a direction parallel to the first and second compressed natural fiber layers. In some embodiments, the cable is not visible from above the first and second compressed natural fiber layers. In some embodiments, the compressed natural fiber earphone support is disposed over the compressed natural fiber cable support with a majority of the cable disposed between the compressed natural fiber earphone support and the cable support.

BRIEF DESCRIPTION OF THE DRAWINGS

The disclosure will be readily understood by the following detailed description in conjunction with the accompanying drawings, wherein like reference numerals designate like structural elements, and in which.

DETAILED DESCRIPTION

Figure 1:
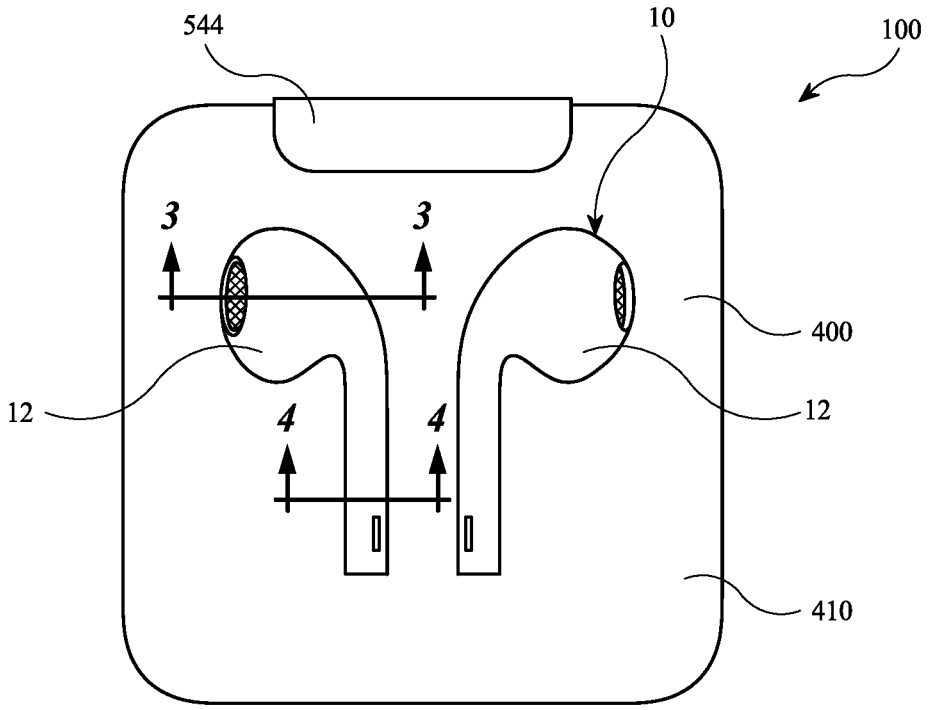
FIG. 1 shows a top view of an earphone package according to some embodiments.

Reference will now be made in detail to representative embodiments illustrated in the accompanying drawings. It should be understood that the following descriptions are not intended to limit the embodiments to one preferred embodiment. To the contrary, it is intended to cover alternatives, modifications, and equivalents as can be included within the spirit and scope of the described embodiments as defined by the claims.

This disclosure relates generally to packaging, and more specifically, to earphone packaging. While earphone packaging is specifically discussed, the principles discussed herein are also applicable to packaging for other products. In some embodiments of the present invention, the packaging may be used for any product, particularly for small, lightweight products.

Packaging may be used, for example, to store, transport, protect and/or present products, such as earphones or other electronic devices, to consumers. In some embodiments, earphone packaging may be designed to accomplish several goals. For example, the packaging may protect the earphones (e.g., by securing the earphones in place) while presenting the earphones to consumers, including making the earphones easily accessible for consumers to remove the earphones from the packaging. The use of adhesives may, for example, secure earphones in place, but adhesives may make it more difficult for consumers to remove the earphones from the packaging. Thus, in some embodiments the packaging described herein secures earphones in place while also making earphones easily accessible by using mechanisms and techniques that minimize the use of adhesive. At the same time, because the packaging may be discarded, in some embodiments the packaging is made with a minimal amount of material, and the material is environmentally friendly (e.g., recyclable, for example in a conventional paper recycling stream without requiring deconstruction of the packaging and separation of its component parts).

In some embodiments, packaging may be formed of layers of compressed natural fibers (e.g., paper or cardboard, formed of, for example, cellulose, bagasse, or bamboo fibers). The layers of compressed natural fibers may be attached to one another to form the packaging. In some embodiments, the layers of compressed natural fibers are attached by high-frequency welding. In some embodiments, the layers of compressed natural fibers may be attached to one another by adhesive.

In some embodiments, an upper surface layer of the packaging defines one or more apertures that receive part of a product. For example, the upper surface layer may include two apertures, one for each earphone in a pair. The apertures may conform to the outline of the earphones, but be slightly smaller than the earphones, so that the earphones can rest against the perimeter of the aperture from underneath without going through the apertures. This can help present the earphones as "floating" within the packaging on the upper surface, especially without any other anchoring or affixing mechanism viewable from above the upper surface. Additional apertures, either in the same layer or a different layer, may be included to receive, for example, a headphone jack, adapter, or other type of electrical connector (e.g., a USB device, an adapter, a power plug, etc.).

In some embodiments, a layer of compressed natural fibers adjacent to an aperture includes one or more flaps partially covering the apertures in the adjacent layer. The flap may be biased towards the aperture so that when a product is placed between the flap and the aperture the product is secured in place between the flap and the perimeter of the aperture. In some embodiments, two flaps together secure the product in place. In this way, the flaps can secure the product in place from below the upper visible surface, allowing the product to be showcased from the opposite side of the aperture without the flaps themselves being visible. Furthermore, the flaps may allow easy access to the product for removal from the packaging. For example, the product may be removed by pulling the product between the flaps.

In some embodiments, because the particular part of the product is larger than the aperture, the flaps and a perimeter of the aperture form a space for storing the particular part of the product. In some embodiments, a portion of the product extends beyond this space (i.e., above the layer that has the aperture). This portion of the product may be displayed to consumers, thus showcasing the product.

In some embodiments, the packaging stores the remainder of the product, such as the cables of the earphones, below the upper layer to be primarily out of sight from the consumer's view. For example, one or more layers of compressed natural fibers may provide a guide to wrap the cables in an annular (e.g., circular) pattern within the packaging. In some embodiments, one or more layers of compressed natural fibers may have tabs to close the packaging.

These and other embodiments are discussed below with reference to the figures. However, those skilled in the art will readily appreciate that the detailed description given herein with respect to these figures is for explanatory purposes only and should not be construed as limiting.

Figure 2:
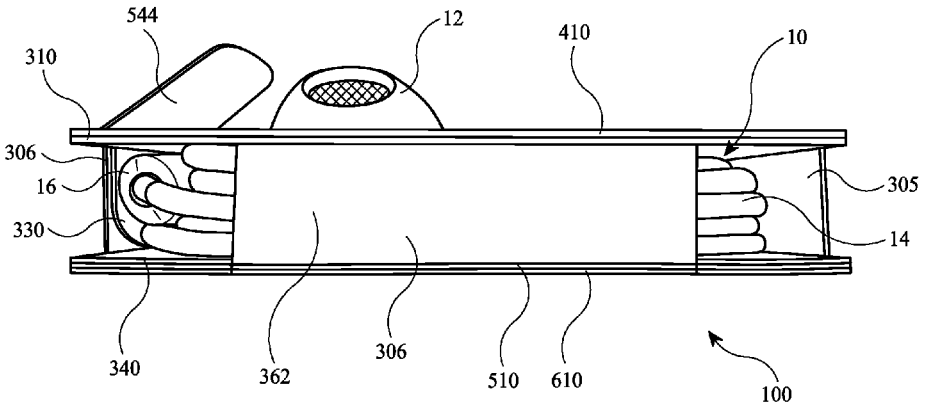
FIG. 2 shows a side view of an earphone package according to some embodiments.

Packaging 100, as shown, for example, in FIGS. 1 and 2, may be used to store, transport, protect, and/or present a product 10 or other item, such as, for example, earphones (sometimes referred to as in-ear headphones or ear pods). In some embodiments, portions of product 10 may be disposed within an interior of packaging 100 and other portions of product 10 may be disposed outside of the interior of (e.g., above) packaging 100. This may allow a particular part of product 10 to be displayed or presented to consumers while hiding the remainder of product 10 from view.

For example, as shown in FIGS. 1 and 2, product 10 may include a product body 12 and a cable 14 connected to product body 12. In some embodiments, product 10 includes two product bodies 12 (e.g., two earphones). In some embodiments, a portion of product body 12 is disposed above an upper layer 400 of packaging 100. In some embodiments, a portion of product body 12 is disposed within packaging 100. In some embodiments, cable 14 is not visible from above packaging 100 (see FIG. 1). In some embodiments, cable 14 may be visible from a side view of packaging 100 (see FIG. 2).

In some embodiments, packaging 100 is configured to support product 10 in the manner described above (i.e., presenting product body 12 while hiding cable 14) so that product 10 stays in place in the absence of applied force, but is also easily and quickly removable from packaging 100. In some embodiments, packaging 100 comprises a plurality of layers of compressed natural fibers, such as paper, to accomplish this.

Figure 8:
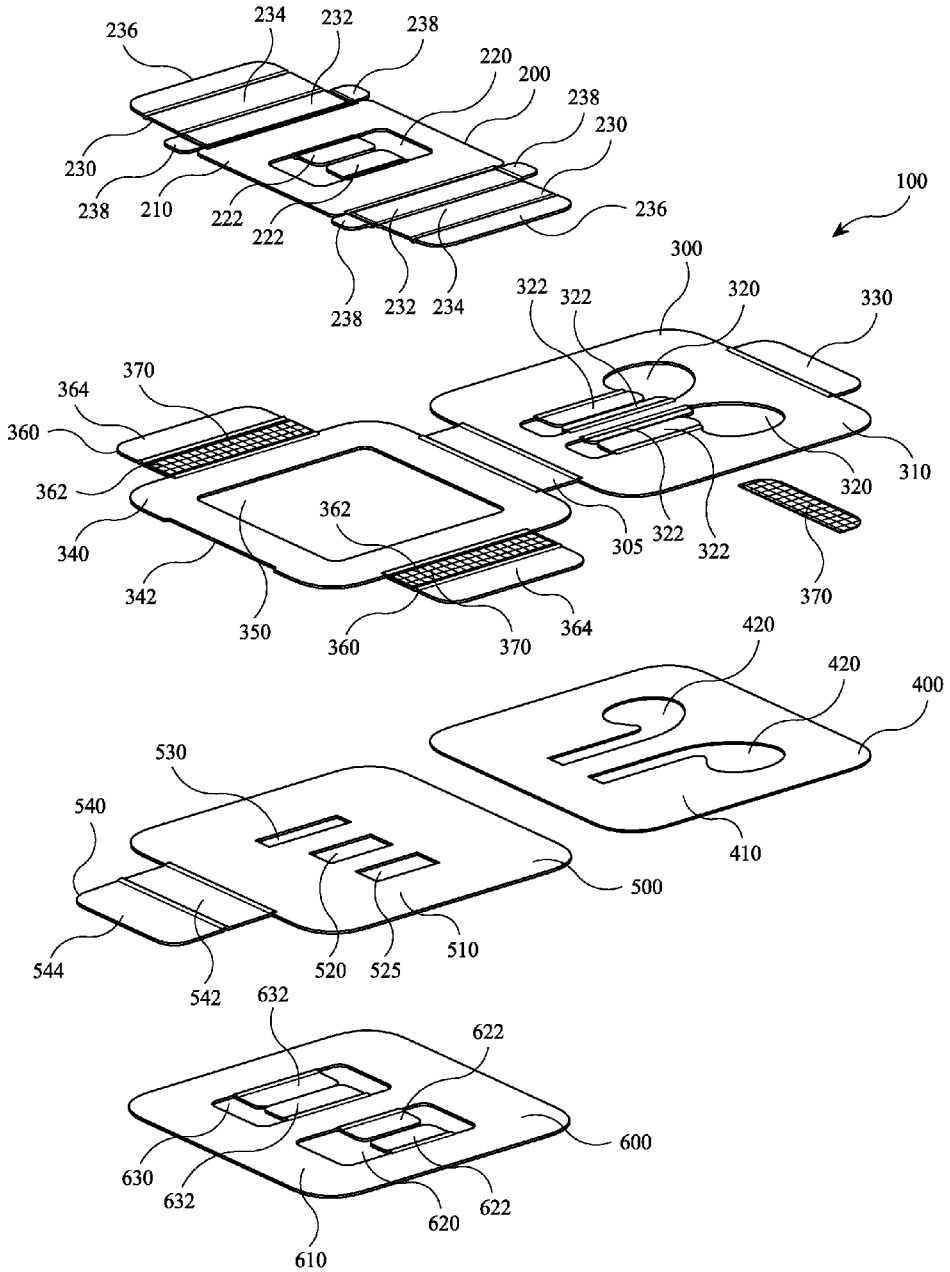
FIG. 8 shows an exploded view of an earphone package according to some embodiments.

In some embodiments, various layers of packaging 100 include apertures (e.g., apertures 220, 320, 420, 520, 525, 530, 620, and 630) to receive portions of product 10 (see, e.g., FIG. 8). In some embodiments, various layers of packaging 100 include flaps (e.g., flaps 222, 322, 622, and 632) to at least partially cover the apertures and thereby secure the portions of product 10 in place. In some embodiments, the dimensions of the flaps are sized appropriately to secure the particular portion of product 10 in place. For example, in some embodiments, the flaps may extend across an entire aperture. In some embodiments, the flaps may extend along at least half of the length of the exposed portion of product 10. In some embodiments, the portions of product 10 may be pulled between the flaps to remove product 10 from packaging 100. In some embodiments, various layers of packaging 100 include tabs (e.g., tabs 230 and sections 238) to guide portions of product 10, such as cable 14, within packaging 100. In some embodiments, various layers of packaging 100 may include tabs (e.g., tabs 330, 360, and 540) to form sidewalls 306 of packaging 100 (i.e., sides of packaging 100 that appear similar in shape and location to sidewall 305 when packaging 100 is closed).

Figure 3:
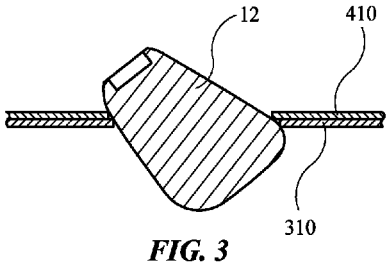
FIG. 3 shows a partial cross-sectional view taken along line 3-3 of FIG. 1.
Figure 4:
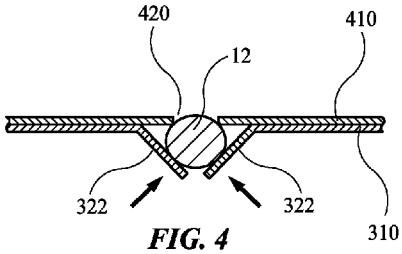
FIG. 4 shows a partial cross-sectional view taken along line 4-4 of FIG. 1.

In some embodiments, apertures (e.g., apertures 320 and 420) and flaps (e.g., flaps 322) create a space to contain product body 12, as shown, for example, in FIGS. 3 and 4. FIGS. 3 and 4 are schematic representations of partial cross-sections through portions of an aperture and product at locations without flaps (FIG. 3) and with flaps (FIG. 4). In some embodiments, a portion of product body 12 extends above product body section 410, which may form part of upper layer 400 of packaging 100, as described below. In some embodiments, a portion of product body 12 extends below product body section 310, which may form part of a layer 300 below upper layer 400. Because the edges of product body section 410 and 310 (i.e., the perimeters of apertures 420 and 320) are not perfectly aligned (see FIG. 3), product body 12 is less likely to rotate from the desired position of product body 12 for presentation to consumers, as it is partially cradled against the offset between layers. In some embodiments, as shown, for example, in FIG. 4, flaps 322 are biased toward apertures 420. Thus, in some embodiments, flaps 322 are biased to press product body 12 against the perimeter of aperture 420.

In some embodiments, the perimeter of aperture 420 is smaller than a perimeter of product body 12, or the distance between opposing sides of the aperture is smaller than the width of a corresponding portion of product body 12 (as shown, for example, in FIG. 4). Thus, product body 12 may not fit through aperture 420 unless product body 12 is forced through, layer 400 is flexed, or some other manipulation of packaging 100 allows product body 12 to pass through aperture 420. In the absence of applied force, product body 12 is secured in place in packaging 100 with only a portion of product body 12 being displayed to consumers (see FIG. 1). In some embodiments, although flaps 322 are biased to press product body 12 toward the perimeter of aperture 420, product body 12 may be easily removed from packaging 100 by applying force to overcome the bias and pull product body 12 between flaps 322.

In some embodiments, product body section 310 and product body section 410 together secure product body 12 in packaging 100. In some embodiments, apertures 320 and 420 may imitate the shape of product body 12. For example, while both apertures 320 and apertures 420 may follow the same contour of the shape of product body 12, they may overlap portions of product body 12 to different degrees such that the shape of aperture 320 may slightly differ from the shape of aperture 420. In some embodiments, as shown, for example, in FIG. 5, the perimeter of aperture 320 does not match up with the perimeter of aperture 420. Thus, a portion of product body section 410 may protrude to partially cover aperture 320. Similarly, in some embodiments, as shown, for example, in FIG. 6, the perimeter of aperture 420 does not match up with the perimeter of aperture 320. Thus, a portion of product body section 310 may protrude to partially cover aperture 420. In some embodiments, the difference in perimeters of apertures 320 and aperture 420 contributes to securing product body 12 in place. For example, product body 12 may rest on the portion of product body section 310 that protrudes to partially cover aperture 420, which may assist in preventing rotation of product body 12 or preventing product body 12 from slipping out of place. As an additional example, the portion of product body section 410 that protrudes to partially cover aperture 320 may also assist in preventing rotation of product body 12 or preventing product body 12 from slipping out of place.

In some embodiments, aperture 320 and/or aperture 420 may constrain product body 12 in an X and Y direction while flaps 322 may constrain product body 12 in a Z direction (e.g., by being biased to press product body 12 against the perimeter of aperture 320 and/or aperture 420. In some embodiments, cable 14 extends from product body 12 in a direction parallel to product body section 310 and product body section 410. In some embodiments, cable 14 abuts the bottom of product body section 310 where cable 14 extends from product body 12.

Figure 7:
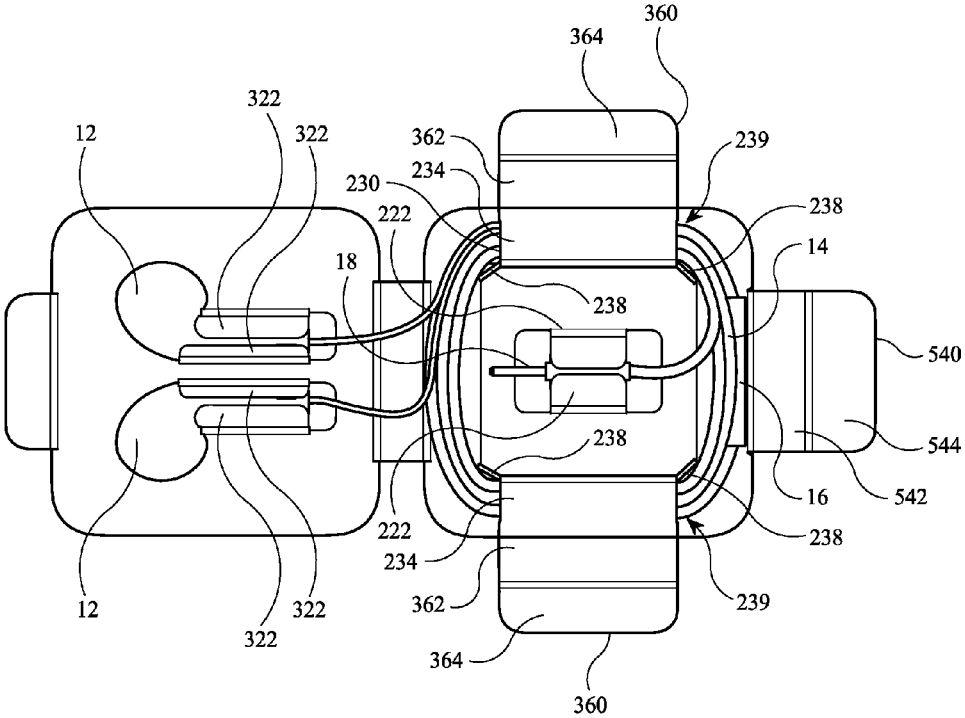
FIG. 7 shows an interior view of an earphone package in an open configuration according to some embodiments.

In some embodiments, additional apertures and flaps may be used in other layers to house other portions of product 10, such as connector 18, as shown, for example, in FIG. 7. In some embodiments, additional apertures and flaps may be used to house additional accessories. For example, in some embodiments, as shown in FIG. 8, packaging 100 comprises layer 200, layer 300, layer 400, layer 500, and layer 600. Each of these layers may include one or more apertures and/or one or more flaps, as described in more detail below. In some embodiments, more or fewer layers may be used. The number of layers may depend on the type of product 10 within packaging 100 or the number of accessories included in packaging 100.

Figure 9:
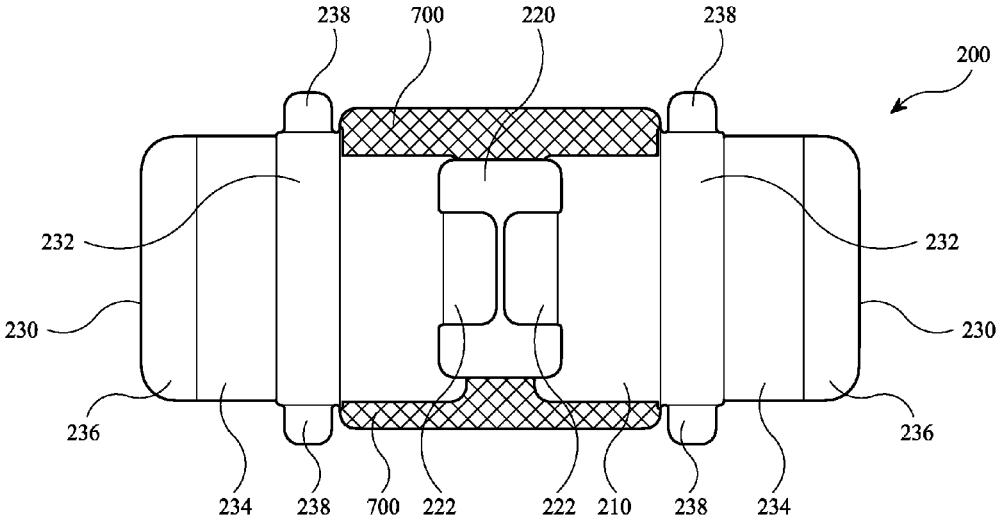
FIG. 9 shows a portion of an earphone package according to some embodiments.

In some embodiments, layer 200, as shown, for example, in FIG. 9, operates as a cable guide portion of packaging 100. In some embodiments, layer 200 comprises a center section 210. In some embodiments, center section 210 defines an aperture 220. In some embodiments, one or more flaps 222 (e.g., two flaps 222) extend from center section 210 over aperture 220. In some embodiments, tabs 230 extend from opposite ends of center section 210. Tabs 230 may be folded to create the cable guide portion of packaging 100.

For example, tabs 230 may include sections 232, 234, 236, and 238. In some embodiments, sections 232, 234, and 236 may be folded (e.g., at right angles to each other) to form a passageway 239 for retaining cable 14 coiled within packaging 100 (see FIG. 7). In some embodiments, section 232 is folded at a 90 degree angle to center section 210 to form an inner sidewall of the passageway 239. In some embodiments, section 234 is folded at a 90 degree angle to section 232 to form a top of the passageway 239. In some embodiments, section 236 is folded at a 90 degree angle to section 234 to form an outer sidewall of the passageway 239. Thus, cable 14 may be coiled within packaging 100, and passageway 239 may be created by folding sections 232, 234, and 236, as described above, around cable 14 such that cable 14 passes between sidewall sections 232 and 236 and underneath top section 234 (see FIG. 7).

In some embodiments, sections 238 are folded towards the center of layer 200 to act as tabs against which cable 14 coils within packaging 100 (see FIG. 7). The diameter at which cable 14 coils within packaging 100 may depend on the degree to which sections 238 are folded relative to section 232, thereby providing flexibility in the coil diameter of cable 14, which can help to ensure that components of product 10 along the coil are arranged in an appropriate location while allowing consistent coiling of turn of coiled cable 14. For example, a controller 16 positioned along a part of cable 14 may not have the same flexibility as cable 14, so it is intended that controller 16 will be arranged along one of the straight sidewalls 306 of packaging 100 rather than at a corner where cable 14 bends. Since sections 238 can bend to accommodate differing coil diameters, the appropriate diameter may be used so that controller 16 ends up in the desired position around a perimeter of packaging 100. Other components of product 10 along cable 14 can be positioned similarly, such as a connector 18, which may be positioned in a center of packaging 100 (e.g., within aperture 220 and underneath flap 222) based on the angle between sections 232 and sections 238 when sections 238 are folded towards the center of layer 200.

In some embodiments, the angle between sections 232 and sections 238 is between 10 and 60 degrees. In some embodiments, the angle between sections 232 and sections 238 is between 30 and 50 degrees. In some embodiments, the angle between sections 232 and sections 238 is about 45 degrees. In some embodiments, the diameter at which cable 14 coils within packaging 100 may be between 30 and 50 millimeters. In some embodiments, the diameter at which cable 14 coils within packaging 100 may be about 40 millimeters. Other angles and diameters may be utilized depending on the characteristics of product 10. For example, the length of cable 14 or the distance between components thereof may affect the desired angle between sections 232 and sections 238 and the desired diameter at which cable 14 coils within packaging 100.

Figure 10:
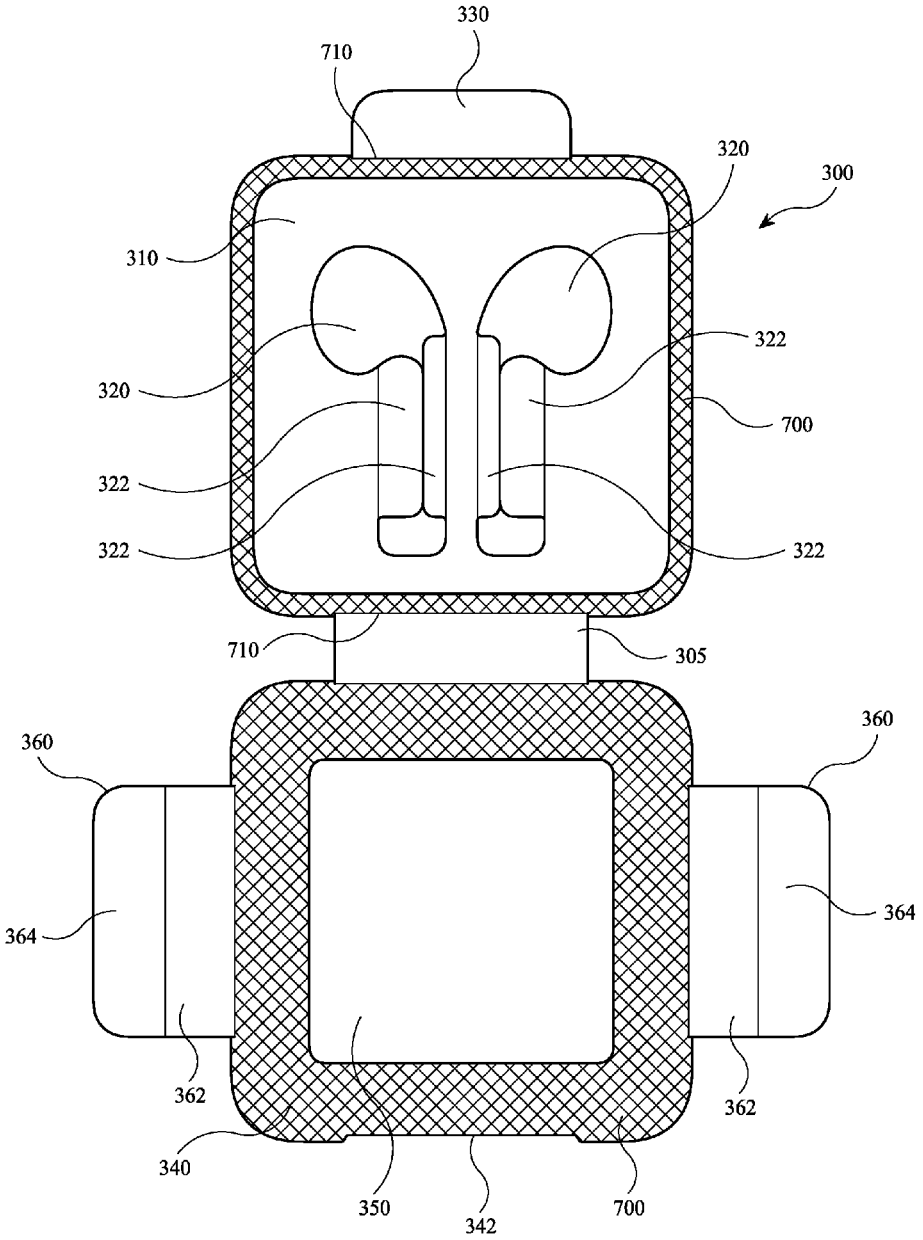
FIG. 10 shows a portion of an earphone package according to some embodiments.

In some embodiments layer 300, as shown, for example, in FIG. 10, operates as a product body support portion and as a cable support portion. In some embodiments, layer 300 comprises a product body section 310 and a cable section 340. In some embodiments, product body section 310 and cable section 340 are connected via sidewall 305. In some embodiments, product body section 310, cable section 340 and sidewall 305 are monolithic. In some embodiments, product body section 310, cable section 340, and sidewall 305 fold relative to each other so that product body section 310 is parallel with cable section 340 and separated from cable section 340 by a distance equal to the height of sidewall 305. For example, product body section 310 may form part of a top portion of packaging 100, cable section 340 may form part of a bottom portion of packaging 100, and sidewall 305 may form part of a side portion of packaging 100.

In some embodiments, product body section 310 defines an aperture 320. In some embodiments, product body section 310 defines two apertures 320. In some embodiments, apertures 320 are configured to receive product body 12. In some embodiments, the shape of apertures 320 imitate the shape of product body 12 (i.e., are shaped to follow a contour of a perimeter of product body 12). In some embodiments, one or more flaps 322 extend from product body section 310 over each aperture 320. For example, two flaps 322 may extend over each aperture 320. In some embodiments, a tab 330 extends from product body section 310 on a side opposite from sidewall 305. In some embodiments, tab 330 forms a portion of a sidewall 306 opposite sidewall 305. For example, as shown cross-hatched in FIG. 8, an adhesive 370 may be disposed on one side of tab 330 to attach to a section 542 from layer 500 to form a sidewall 306 opposite sidewall 305.

In some embodiments, cable section 340 defines aperture 350, which may provide a space to accommodate parts of product 10 (e.g., parts that are disposed within other apertures secured by flaps as described above). In some embodiments, aperture 350 is similar in shape to center section 210 of layer 200. In some embodiments, cable 14 coils within packaging 100 and rests on cable section 340. In some embodiments, cable section 340 forms a bottom portion of passageway 239. In some embodiments, tabs 360 extend from opposite ends of cable section 340. Tabs 360 may be folded to create sidewalls 306 of packaging 100.

For example, tabs 360 may include sections 362 and 364. In some embodiments, section 362 is folded at a 90 degree angle to cable section 340 to form a sidewall 306 of packaging 100. In some embodiments, section 364 may fold over the top of section 234. In some embodiments, section 364 may be disposed between section 234 and product body section 310.

In some embodiments, an adhesive 370 may be disposed on section 362, as shown cross-hatched in FIG. 8. For example, section 362 may be adhered to section 236 of layer 200. This arrangement may hold the passageway 239 formed by sections 232, 234, and 236 in place. In some embodiments, adhesive 370 may be double-sided adhesive. In some embodiments, adhesive 370 is a differential adhesive, with one side of adhesive 370 having greater tack than the other side, which may help a consumer open packaging 100 when desired without tearing up portions of the packaging along with the adhesive, since the adhesive will have a natural tendency to stay together on the side with the higher tack. Because adhesive 370 may attach to section 362 and section 236, when packaging 100 is opened by separating sections 362 and 236, the passageway 239 surrounding cable 14 is also opened, allowing cable 14 to be easily removed from packaging 100. For example, after passageway 239 is opened, tabs 230 may be easily folded back to allow consumers to remove cable 14 from its position within packaging 100.

In some embodiments, cable section 340 comprises an indent 342 on a side of cable section 340. For example, indent 342 may be disposed on the side of cable section 340 opposite from sidewall 305. In some embodiments, indent 342 provides a space for an additional side wall formed by another layer (such as layer 500). In some embodiments, indent 342 allows a side wall to close packaging 100 without protruding beyond the perimeter of product body section 410 (see FIG. 1).

Figure 11:
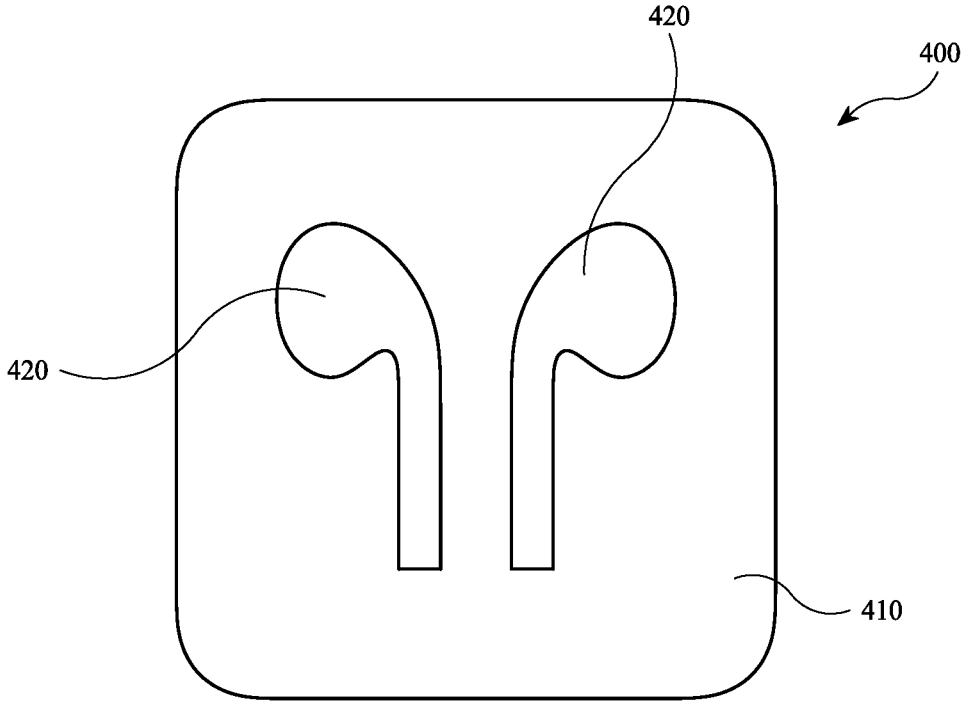
FIG. 11 shows a portion of an earphone package according to some embodiments.

In some embodiments layer 400, as shown, for example, in FIG. 11, operates as a second layer of a product body support portion. In some embodiments, layer 400 comprises a product body section 410. In some embodiments, product body section 410 defines an aperture 420. In some embodiments, product body section 410 defines two apertures 420.

In some embodiments, apertures 420 are configured to receive product body 12. In some embodiments, the shape of apertures 320 imitate the shape of product body 12 (i.e., are shaped to follow a contour of a perimeter of product body 12). Apertures 420 may be generally the same shape as apertures 320, but slightly offset to different degrees around their peripheries, as described above (see, e.g., FIGS. 3 and 4). In some embodiments, product body section 410 forms a top layer of packaging 100.

Figure 12:
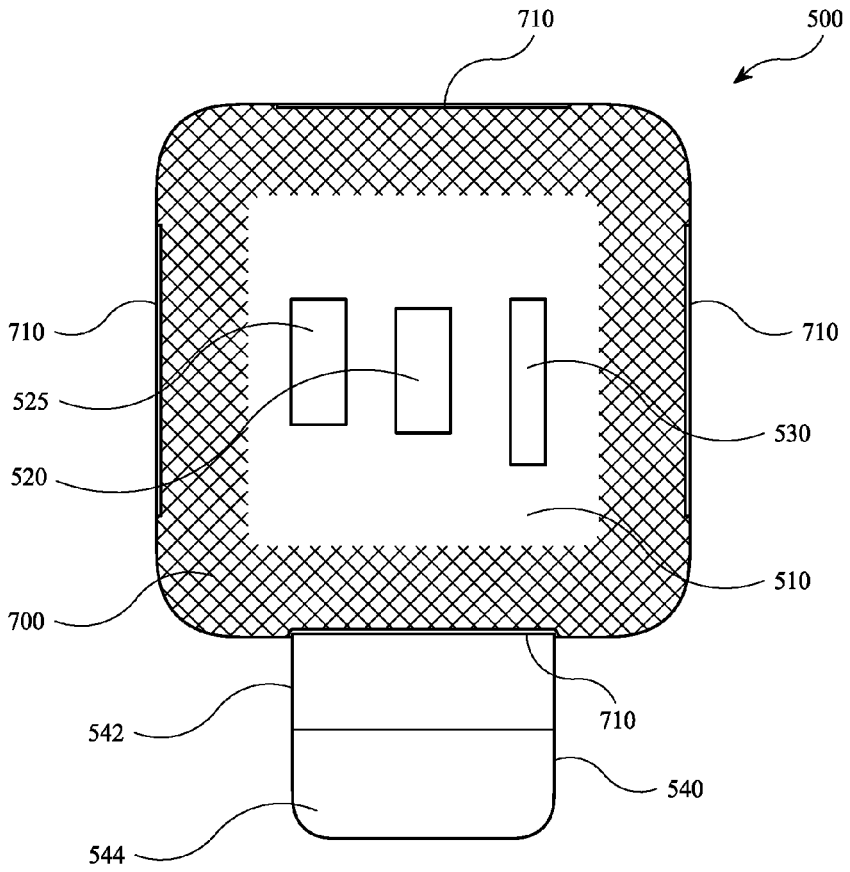
FIG. 12 shows a portion of an earphone package according to some embodiments.

In some embodiments layer 500, as shown, for example, in FIG. 12, operates as a connector support portion. In some embodiments, layer 500 is disposed below layer 300. In some embodiments, layer 500 comprises a connector section 510. In some embodiments, embodiments, connector section 510 defines aperture 520. In some embodiments, aperture 520 is sized to receive connector 18 (e.g., headphone jack, adaptor, or other electrical connector) of product 10. In some embodiments, aperture 520 and flaps 222 operate in a similar manner as aperture 420 and flaps 322 to secure connector 18. For example, aperture 520 may constrain connector 18 in an X and Y direction while flaps 222 may constrain connector 18 in a Z direction (e.g., by being biased to press connector 18 against the perimeter of aperture 520).

In some embodiments, a tab 540 extends from connector section 510. Tab 540 may comprise section 542 and section 544. In some embodiments, section 542 may form a sidewall 306 of packaging 100 (e.g., by attaching to tab 330 via adhesive 370). In some embodiments, section 544 may fold over the top of product body section 410, as shown, for example, in FIG. 1.

In some embodiments, connector section 510 only defines one aperture (e.g., aperture 520). In some embodiments, connector section 510 defines one or more additional apertures, such as aperture 525 and aperture 530. In some embodiments, aperture 525 and aperture 530 are configured to receive a portion of an accessory for product 10, such as an adaptor. In some embodiments, aperture 525 and aperture 530 are configured to receive different portions of the same accessory. In some embodiments, aperture 525 may receive a portion of a different accessory than an accessory received by aperture 530.

Figure 13:
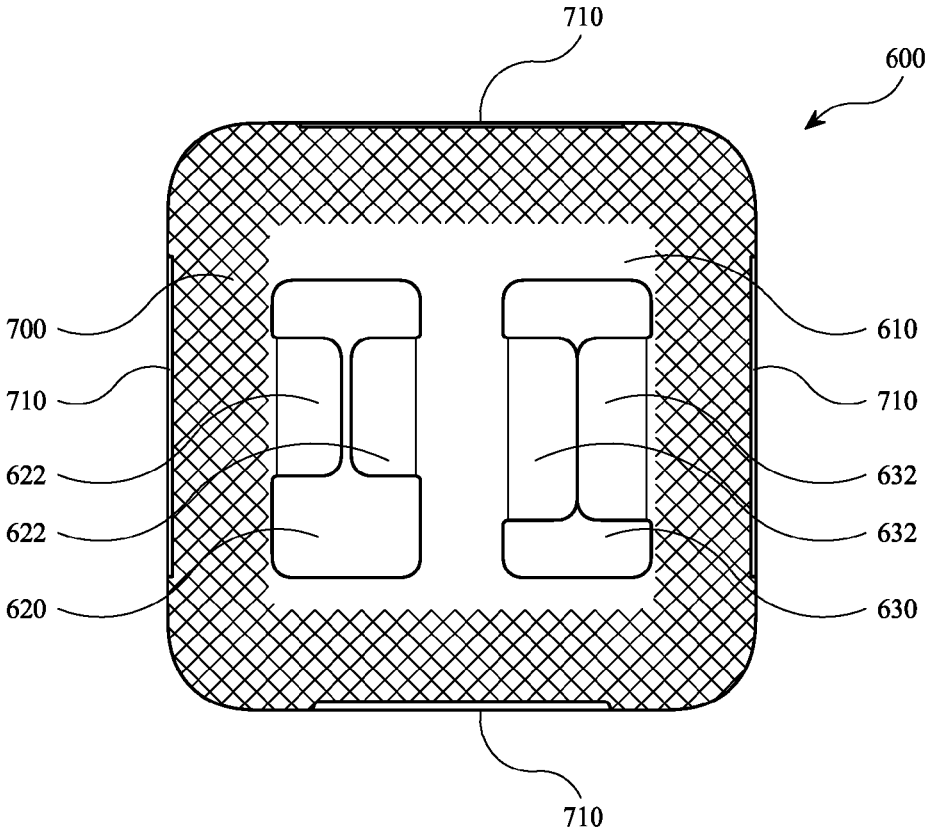
FIG. 13 shows a portion of an earphone package according to some embodiments.

In some embodiments, layer 600, as shown, for example, in FIG. 13, may operate as an accessory support portion. For example, layer 600 may be disposed below connector section 510 to house an accessory. In some embodiments, layer 600 comprises an accessory section 610. In some embodiments, accessory section 610 completely covers aperture 520, and thus, may help constrain connector 18 in a Z direction.

In some embodiments, accessory section 610 may define one or more apertures, such as apertures 620 and 630. In some embodiments, one or more flaps 622 (e.g., two flaps 622) extend from accessory section 610 over aperture 620. In some embodiments, aperture 525 and flaps 622 operate in a similar manner as aperture 420 and flaps 322 to secure a portion of an accessory. For example, aperture 525 may constrain a portion of the accessory in an X and Y direction while flaps 622 may constrain the portion of the accessory in a Z direction (e.g., by being biased to press the portion of the accessory against the perimeter of aperture 525).

In some embodiments, one or more flaps 632 (e.g., two flaps 632) extend from accessory section 610 over aperture 630. In some embodiments, aperture 530 and flaps 632 operate in a similar manner as aperture 420 and flaps 322 to secure a portion of an accessory. For example, aperture 530 may constrain a portion of the accessory in an X and Y direction while flaps 632 may constrain the portion of the accessory in a Z direction (e.g., by being biased to press the portion of the accessory against the perimeter of aperture 530).

In some embodiments, center section 210 of layer 200 completely covers apertures 620 and 630, and thus, may help constrain portions of the accessory in a Z direction. In some embodiments, layer 600 may not be included in packaging 100, with layer 500 being the bottom layer. In some embodiments, this may leave a portion of connector 18 exposed.

As discussed above, packaging 100 is formed from a plurality of layers of compressed natural fibers, such as paper. In some embodiments, each layer comprises paper of the same grammage (grammage being a measure of mass per unit of area). In some embodiments, some layers may comprise different grammages. For example, in some embodiments, all layers have the same grammage (e.g., a grammage of 300) except for layer 400. In some embodiments, layer 400 comprises paper having a greater grammage than layers 200, 300, 500, and 600 (e.g., layer 400 may have a grammage greater than 120% of the grammage of layers 200, 300, 500, and 600, such as, for example, a grammage of 380). In some embodiments, the greater grammage of layer 400 may contribute to securing product body 12 in place and may provide reinforcing structure for packaging 100 so that packaging 100 can maintain its shape through the packaging, shipping, and handling processes while using lower grammage material for the other layers, thereby reducing waste and weight of packaging 100 overall. For example, the greater grammage of layer 400 may provide greater stiffness, thus contributing to the prevention of rotation of product body 12 and the prevention of flexing of packaging 100.

In some embodiments, each layer of packaging 100 may be formed from a sheet of compressed natural fibers. In some embodiments, each layer of packaging is formed only of compressed natural fibers. In some embodiments the entirety of packaging 100 is formed of compressed natural fiber layers and adhesives. In some embodiments the entirety of packaging 100 is formed of compressed natural fiber layers, adhesives, and polypropylene laminate.

In some embodiments, each layer is die-cut from a sheet of compressed natural fibers. In some embodiments, layers that have similar outer perimeters (e.g., a portion of layer 300 and layer 400) may be die-cut together. In some embodiments, portions of the layers that will be folded are scored (e.g., compressed to provide a crease or cut less-than-completely through the layer, with or without removing material with the cut such as with a v-shaped miter cut) to help each fold be accurate. For example, in some embodiments, flaps 222, 322, 622, and 632 are scored at a location to contribute to biasing flaps 222, 322, 622, and 632 to press against the portion of product 10 that is being held in place, while also allowing insertion of product 10 during assembly of packaging 100 without damaging flaps 222, 322, 622, and 632.

In some embodiments, the process of die-cutting and the process of scoring are done simultaneously. In some embodiments, the layers of packaging 100 are die-cut in a downward direction. In some embodiments, the layers of packaging 100 are die-cut in an upward direction. In some embodiments, different layers are die-cut in different directions. For example, in some embodiments, layer 200 may be die-cut in a downward direction and layers 300, 500, and 600 are die-cut in an upward direction.

In some embodiments, the process of die-cutting may contribute to allowing the majority of packaging 100 to be hidden from a consumer's view from above the top layer (e.g., layer 400). For example, the die-cut pattern of tab 540, tab 330, tabs 360, and sidewall 305 may cut into a portion of cable section 340 and connector section 510. Thus, when tab 540, tab 330, tabs 360, and sidewall 305 are formed into the sidewalls 305 and 306 of packaging 100, they may be disposed at least slightly underneath product body section 310 and hidden from view, rather than bulging out from underneath product body section 310.

Figure 5:
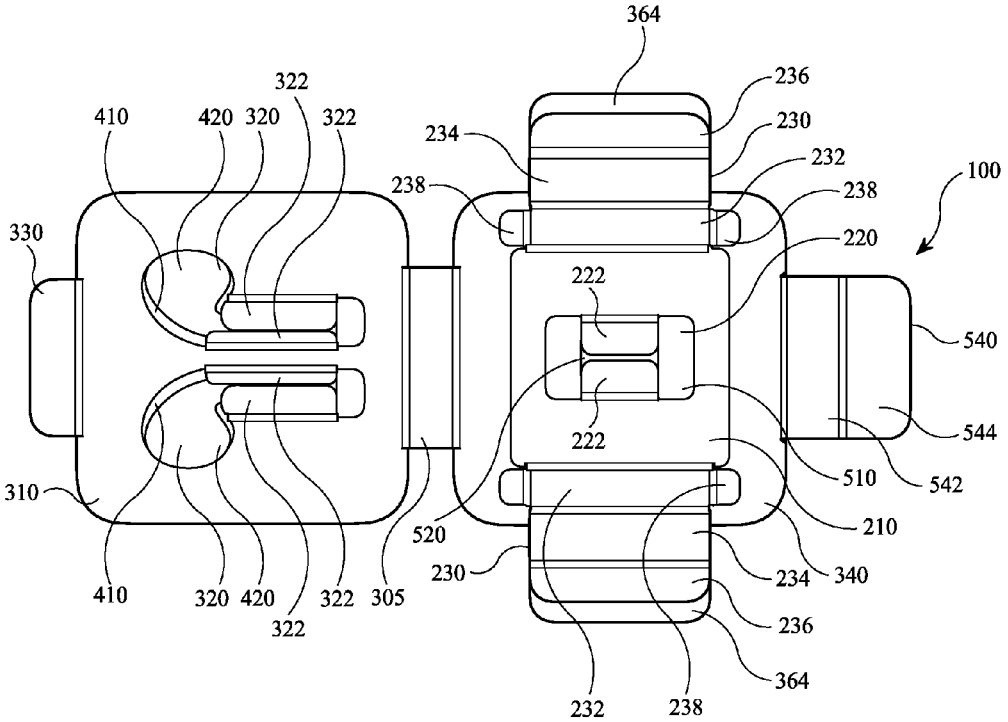
FIG. 5 shows an interior view of an earphone package in an open configuration according to some embodiments.
Figure 6:
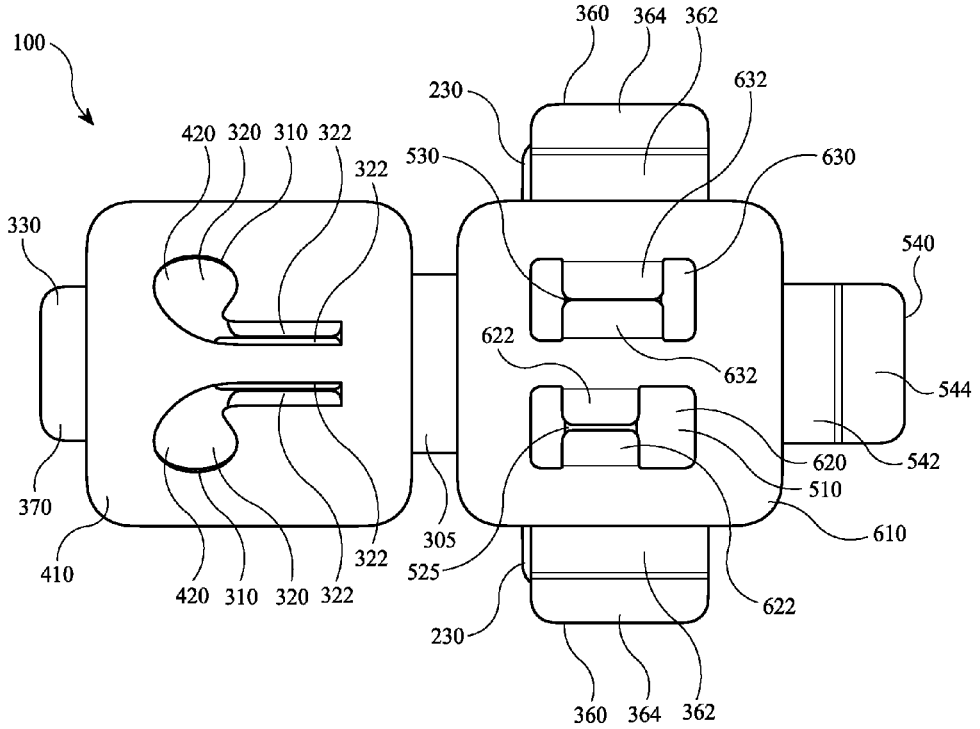
FIG. 6 shows an exterior view of an earphone package in an open configuration according to some embodiments.

In some embodiments, one or more layers (e.g., layers 200, 300, 400, 500, and 600) may be attached to one another to form packaging 100, as shown, for example, in FIGS. 5 and 6. Various layers (e.g., layers 200, 300, 400, 500, and 600) may be adhered together by, for example, tape (e.g., double-sided tape) or glue, or by high-frequency welding. High-frequency welding provides a strong bond and a clean edge, avoiding potential exposed tape or glue. In some embodiments, each layer comprises a coating to facilitate high-frequency welding. For example, each layer may comprise a coating of polypropylene laminate. In some embodiments, the polypropylene laminate of one layer (e.g., layers 200, 300, 400, 500, or 600) may be high-frequency welded to the polypropylene laminate of an adjacent layer. By bonding the polypropylene laminate of one layer to the polypropylene laminate of an adjacent layer, adjacent layers may be adhered or bonded together. In some embodiments, layers 200, 300, 400, 500, and 600 may be adhered together by high-frequency welding by applying heat and pressure in areas 700, as shown cross-hatched in FIGS. 9, 10, 12, and 13. While the cross-hatching of high-frequency welded areas 700 is different than the cross-hatching of adhesives 370, either of these areas could utilize adhesive or welding. In some embodiments, as shown, for example, in FIGS. 10, 12, and 13, an area 710 around the edges of connector section 510, accessory section 610, and product body section 310 are not high-frequency welded to adjacent layers. In some embodiments, this allows the creases formed by scoring to operate and may contribute to allowing the majority of packaging 100 to be hidden from a consumer's view from above the top layer (e.g., layer 400).

In some embodiments, as shown, for example, in FIG. 7, assembled packaging 100 may hold product 10 with product body 12 secured in product body sections 310 and 410 and cable 14, together with controller 16 and connector 18, secured in center section 210, cable section 340, and connector section 510.

The foregoing descriptions of the specific embodiments described herein are presented for purposes of illustration and description. These exemplary embodiments are not intended to be exhaustive or to limit the embodiments to the precise forms disclosed. All specific details described are not required in order to practice the described embodiments.

It will be apparent to one of ordinary skill in the art that many modifications and variations are possible in view of the above teachings, and that by applying knowledge within the skill of the art, one may readily modify and/or adapt for various applications such specific embodiments, without undue experimentation, without departing from the general concept of the present invention. Such adaptations and modifications are intended to be within the meaning and range of equivalents of the disclosed embodiments, based on the teaching and guidance presented herein. For example, apertures and flaps may be of different shapes and sizes, or in different locations than shown in the figures. In addition, while earphones have been primarily shown in the figures, in some embodiments, other products may be packaged according to the principles disclosed herein.

The detailed description section is intended to be used to interpret the claims. The summary and abstract sections may set forth one or more but not all exemplary embodiments of the present invention as contemplated by the inventor(s), and thus, are not intended to limit the present invention and the claims.

The present invention has been described above with the aid of functional building blocks illustrating the implementation of specified functions and relationships thereof. The boundaries of these functional building blocks have been arbitrarily defined herein for the convenience of the description. Alternate boundaries can be defined so long as the specified functions and relationships thereof are appropriately performed.

The phraseology or terminology used herein is for the purpose of description and not limitation, such that the terminology or phraseology of the present specification is to be interpreted by the skilled artisan.

The breadth and scope of the present invention should not be limited by any of the above-described exemplary embodiments, but should be defined in accordance with the claims and their equivalents.

What is claimed is:

1. A package for an electronic device, the package comprising:

a first layer of compressed natural fibers defining an aperture, the aperture configured to receive a portion of the electronic device; and a second layer of compressed natural fibers disposed adjacent to the first layer of compressed natural fibers, the second layer of compressed natural fibers having a flap partially covering the aperture defined by the first layer of compressed natural fibers, wherein the first and second layers of compressed natural fibers are bonded to each other by high-frequency welding.

2. The package of claim 1, wherein the first layer is paper and wherein the second layer is paper.

3. The package of claim 1, wherein the second layer of compressed natural fibers comprises two flaps partially covering the aperture defined by the first layer of compressed natural fibers.

4. The package of claim 1, further comprising:

a third layer of compressed natural fibers disposed adjacent to the first layer of compressed natural fibers on an opposite side from the second layer of compressed natural fibers, wherein the first layer of compressed natural fibers defines a second aperture, wherein the third layer of compressed natural fibers comprises a flap partially covering the second aperture defined by the first layer, and wherein the third layer of compressed natural fibers completely covers the aperture defined by the first layer of compressed natural fibers.

5. The package of claim 4, wherein the third layer of compressed natural fibers is bonded to the second layer of compressed natural fibers by high-frequency welding.

6. The package of claim 4, wherein the first, second, and third layers of compressed natural fibers are configured to constrain the portion of the electronic device in three dimensions.

7. The package of claim 1, wherein each layer of compressed natural fibers comprises a coating of polypropylene laminate.

8. The package of claim 1, wherein the first layer of compressed natural fibers forms an exterior portion of the package.

9. A packaged product comprising:

the package of claim 1; and a product, wherein the product includes a product body and a cable connected to the product body, wherein a portion of the product body is disposed above the first layer, wherein a portion of the product body is disposed below the first layer, and wherein the cable is not visible from above the first layer.

10. The packaged product of claim 9, wherein a perimeter of the aperture of the first layer is smaller than a perimeter of the product body.

11. The packaged product of claim 9, wherein the flap is biased to press the product body against a perimeter of the aperture.

12. A package for earphones, the package comprising:

a compressed natural fiber earphone support portion comprising a first compressed natural fiber layer and a second compressed natural fiber layer, the first and second compressed natural fiber layers defining two holes configured to secure the earphones;

a compressed natural fiber cable support portion attached to the compressed natural fiber earphone support portion, wherein the cable support portion and the second compressed natural fiber layer are monolithic; and a compressed natural fiber cable guide portion attached to the cable support portion and comprising projections, each projection having tabs on each end disposed at an angle to form an annular guide for a coiled cable of the earphones.

13. The package of claim 12, further comprising a connector support portion attached to the cable support portion, the connector support portion comprising an aperture configured to receive a connector of the earphones.

14. The package of claim 13, further comprising an accessory support portion attached to the connector support portion, wherein the connector support portion comprises an additional aperture configured to receive an accessory.

15. The package of claim 12, wherein the cable guide portion comprises a passageway that surrounds the cable of the earphones, and wherein the passageway is configured to break away when a user opens the package, allowing the cable to be removed from the package.

16. The package of claim 12, further comprising:

a side portion that is monolithic with the compressed natural fiber cable support portion and the second compressed natural fiber layer, wherein the side portion forms a side of the package; and two tabs that extend from the cable support portion and each form a side of the package, wherein the two tabs and the side portion are not visible from above the first compressed natural fiber layer when the package is closed.

17. The package of claim 12, wherein the second compressed natural fiber layer comprises flaps partially covering the two holes to secure the earphones.

18. The package of claim 12, wherein a grammage of the first compressed natural fiber layer is greater than a grammage of the second compressed natural fiber layer.

19. Packaged earphones, comprising:

the package of claim 12; and the earphones, wherein the earphones are secured within the two holes and wherein the cable of the earphones extends from the earphones in a direction parallel to the first and second compressed natural fiber layers, and wherein the cable is not visible from above the first and second compressed natural fiber layers.

20. The packaged earphones of claim 19, wherein the compressed natural fiber earphone support portion is disposed over the compressed natural fiber cable support portion with a majority of the cable disposed between the compressed natural fiber earphone support portion and the cable support portion.

* * * * *